United States Patent [19]

Mosing et al.

[11] Patent Number: 4,676,312

[45] Date of Patent: Jun. 30, 1987

[54] WELL CASING GRIP ASSURANCE SYSTEM

[75] Inventors: Donald E. Mosing, P.O. Box 53909, Lafayette, La. 70505; Charles M. Webre, Lafayette, La.

[73] Assignee: Donald E. Mosing, Lafayette, La.

[21] Appl. No.: 937,894

[22] Filed: Dec. 4, 1986

[51] Int. Cl.[4] ..... E21B 7/20

[52] U.S. Cl. ..... 166/77; 166/381; 173/149; 175/162; 254/31

[58] Field of Search ..... 166/77, 381, 385; 175/162, 203; 254/29 R, 29 A, 30, 31; 173/149

[56] References Cited

U.S. PATENT DOCUMENTS

| | | | |
|---|---|---|---|
| 3,096,075 | 7/1963 | Brown | 166/77 X |
| 3,215,203 | 11/1965 | Sizer | 166/77 |
| 3,708,020 | 1/1973 | Adamson | 173/149 X |
| 3,722,603 | 3/1973 | Brown | 173/149 X |
| 3,999,610 | 12/1976 | Sage et al. | 166/77 X |
| 4,051,988 | 10/1977 | Egerström et al. | 166/77 X |
| 4,085,796 | 4/1978 | Council | 173/149 X |
| 4,476,936 | 10/1984 | Boyadjieff et al. | 166/77 X |
| 4,494,376 | 1/1985 | Beaufort | 166/77 X |
| 4,595,062 | 6/1986 | Boyadjieff et al. | 166/77 X |

*Primary Examiner*—Stephen J. Novosad
*Assistant Examiner*—John F. Letchford
*Attorney, Agent, or Firm*—Matthews & Associates

[57] ABSTRACT

A casing grip assurance interlock system connected with the elevator and the spider of a well casing installation apparatus including positioning valves respectively actuated by the elevator and the spider to permit actuating fluid pressure to be admitted to either the elevator or the spider only when the other of the elevator or spider is positioned to firmly grip the well casing.

12 Claims, 4 Drawing Figures

WELL CASING GRIP ASSURANCE SYSTEM

FIELD OF THE INVENTION

This invention generally relates to methods and apparatus for installing and removing well bore pipe and more particularly pertains to a fluid operated interlock system for assuring that at least one or both of casing elevator slips and casing spider slips have full and complete grip on a well casing before the other slip can be released from the casing.

BACKGROUND OF THE INVENTION

Pneumatic casing tools are gripping devices used to hold and lower tubular well casing into a pre-drilled hole. The tools are used in sets consisting of one elevator slip assembly and one spider slip assembly. The elevator and spider slip assemblies are identical tools except for the accessories used with each tool.

The first problem associated with the use of these tools is related to gripping the casing collar which is of a larger diameter than the nominal diameter of the well casing. The problem is caused by not lowering the elevator slip assembly far enough below the collar. Such slip assemblies are designed such that the gripping forces generated are sufficient for proper gripping only when the slips are lowered sufficiently below a casing collar as to completely grip the nominal diameter of the well casing. When the collar is gripped, the slips are not allowed to go sufficiently deep into the tool body to generate adequate gripping forces. The result is that, when the casing string is lifted with the slips gripping the collar rather than the casing diameter, the drill string will sometimes slip through the slips and drop into well bore below.

The next problem is caused by improper operation of the gripping tools. The person working up in the derrick, called the "stabber", operates the control valve that closes the elevator slips. Once the elevator slips are closed and the weight of the casing string is on the elevator, the stabber sometimes actuates the control valve to the open direction. However, with the string weight hanging on the elevator, the air pressure alone will not open the slips. The proper time to actuate the control valve is after the string is lowered and the spider assembly slips are closed, and not before.

There is an instance when this is a problem. This instance would occur when the pipe is being lowered into the well bore and meets up with some restriction or abutment which prevents downward movement of the casing string. The traveling block and elevator continue to move downward a short distance because of the reaction time of the driller. This situation is a problem when the slips have been actuated in the open direction but have been held down by the weight of the casing string. The weight is no longer on the elevator and the slips consequently open up. If the casing string should suddenly free itself in this manner and drop, neither the spider nor the elevator are in the closed position and the casing string accordingly just drops into the bore hole.

The pertinent and presently known prior art to this invention are U.S. Pat. Nos. 3,215,203; 3,708,020; and 3,722,603.

OBJECTS OF THE INVENTION

The principal object of the present invention is to assure that one set of slips is closed down on the well casing at all times such that one set of slips may not be released from the well casing until the other set of slips has a firm grip on the will casing.

Another object of the present invention is to deactivate the elevator slips and/or the spider slips against inadvertent actuation unless the other set of slips are fully set in gripping position.

SUMMARY OF THE INVENTION

The above and other objects and advantages are attained in apparatus for installing casing in a well bore including a drilling rig having a traveling block and a supportive rig floor, a casing gripping fluid actuated casing elevator assembly carried by the traveling block and a casing gripping fluid actuated casing spider assembly mounted on the rig floor. The elevator assembly and the spider assembly each has a piston in a pressurable closing chamber to actuate slips into gripping engagement with well casing when the closing chamber is pressurized, and also a pressurable opening chamber also containing a piston to move the slips into release from the casing when the opening chamber is pressurized. The improvement is casing grip control apparatus for assuring correct and appropriate gripping of the elevator assembly and the spider assembly onto well casing. The apparatus includes a first two-position control valve respectively connected into the closing chamber and into the opening chamber of the elevator assembly and a second two-position control valve respectively connected into the closing chamber and into the opening chamber of the spider assembly. Each of the first and the second control valves are optionally actuated to admit fluid pressure alternately into a closing chamber and an opening chamber while venting the other chamber to atmosphere. A third two-position control valve is connected to be in a first position when the spider is in fully closed gripping position and in a second position when the spider is in position other than fully closed. A forth two-way control valve is connected to be in a first position when the elevator is in a fully closed gripping position and in a second position when the elevator is in position other than fully closed. The third valve is connected to pass fluid pressure from a pressure source to the first valve only when the third valve is in its first position as caused by the spider being in fully closed gripping position. The fourth valve is connected to pass fluid pressure from a pressure source to the second valve only when the fourth valve is in its first position responding to fully closed gripping position of the elevator. The improvement also includes a method of assuring that at least one of the elevator or the spider is fully closed in gripping connection about a well casing before the other may be released from fully closed gripping connection about a well casing with the steps including: (a) passing fluid pressure from a pressure source through a two-position spider position valve to a two-position elevator valve connected to admit fluid pressure into the elevator slips and optionally directing the fluid pressure to open and to close said elevator with the spider position valve being connected to the spider for passing fluid pressure to the elevator valve only when the spider is fully closed into gripping position about well casing and; (b) passing fluid pressure from a pressure source through a two-position elevator position valve to a spider valve which is connected into the spider and optionally directing the fluid pressure to open and close the spider, the elevator position valve being connected to the elevator for passing fluid pressure to the spider valve only when the elevator valve is fully closed into gripping position about well casing.

DESCRIPTION OF A PREFERRED EMBODIMENT

Figure 1:
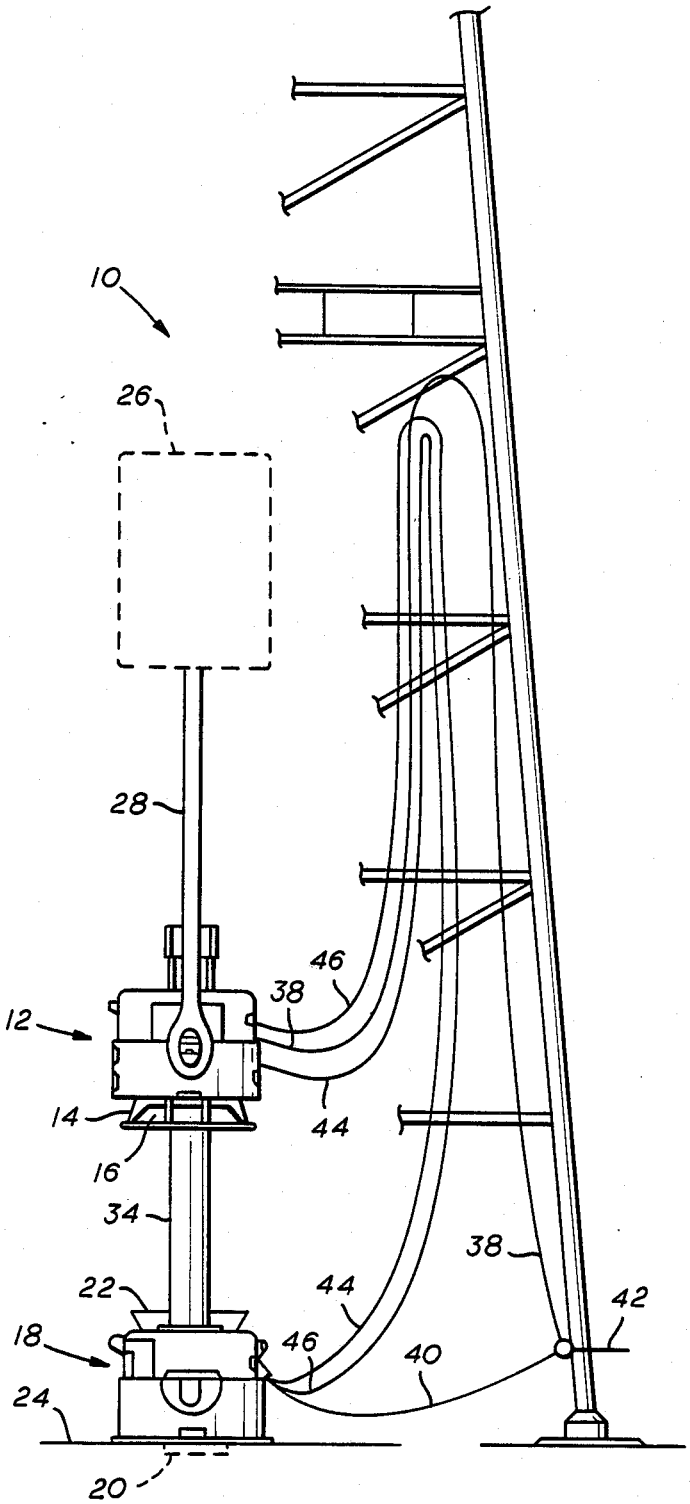
FIG. 1 is a partial elevational view of a drilling rig showing an elevator supported by bales from a traveling block and a spider slip assembly supported by the rig floor.

Referring first to FIG. 1, there is shown the pertinent portion of a drilling rig 10 which is rigged to run well casing with an elevator slip assembly 12 suspended from bales 28 and a traveling block 26 (indicated in dashed lines), and a spider slip assembly 18 supported on the rig floor 24. The elevator 12 carries a bell guide 14 and a casing guide 16. The spider assembly 18 carries a bottom guide 20, shown in dashed lines, and a spider top guide 22 as shown.

As also shown in FIG. 1, the elevator and the spider are air actuated from an air supply 42 which passes through a conduit or hose 38 to the elevator 12 and through a conduit or hose 40 to the spider 18. Interconnected between the elevator 12 and the spider 18 are conduits or hoses 44 and 46 which have a purpose made more clear with reference to FIG. 4.

The air pressure as used herein is sometimes referred to in this specification and claims as fluid pressure and it will be obvious to those skilled in this type of equipment that the equipment is operable with hydraulic fluid which would also be included in the term fluid pressure. Air is the preferred media, however, and this description of the preferred embodiment employs air pressure as the actuating media.

Figure 2:
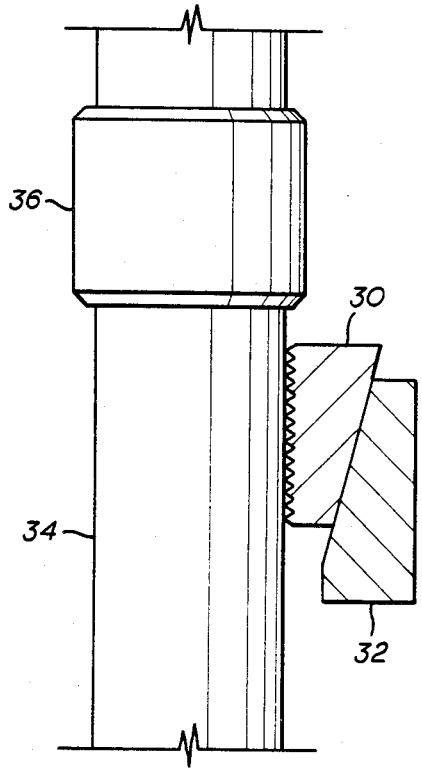
FIG. 2 illustrates the appropriate and proper setting of slips into a bowl to seat about a well casing.

FIG. 2 schematically illustrates a slip member 30 seated in a slip bowl 32 and firmly engaged in gripping contact with well casing 34 just below a casing collar 36. This FIG. 2 illustrates the internal configuration of both the elevator 12 and the spider 18 when the slips 30 are correctly seated.

Figure 3:
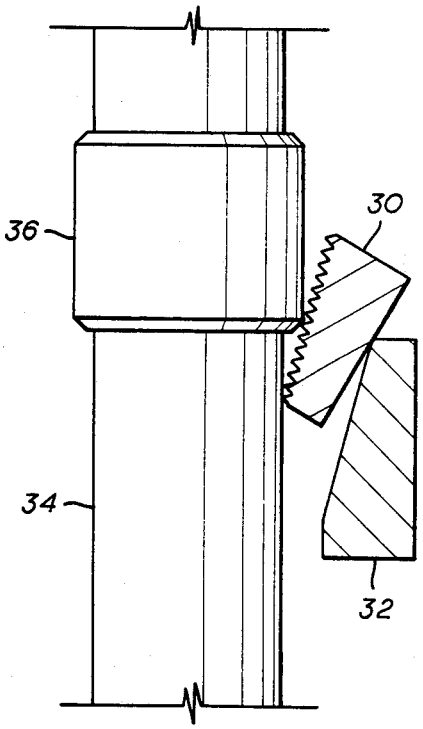
FIG. 3 is an elevational view similar to FIG. 2 but showing the slips incorrectly or improperly seated about the collar of a well casing and not properly seated into the slip bowl.

FIG. 3 schematically illustrates a situation where the slip member 30 has engaged with the casing collar 36, has not been correctly seated in the slip bowl 32, and has not been seated correctly around the casing 34. The "cocking" of the slip 30 is exaggerated but it can be seen that the gripping action of slip member 30 is pecarious at best and subject to being dislodged with little "bumping" of the casing against some obstruction in the well bore.

Figure 4:
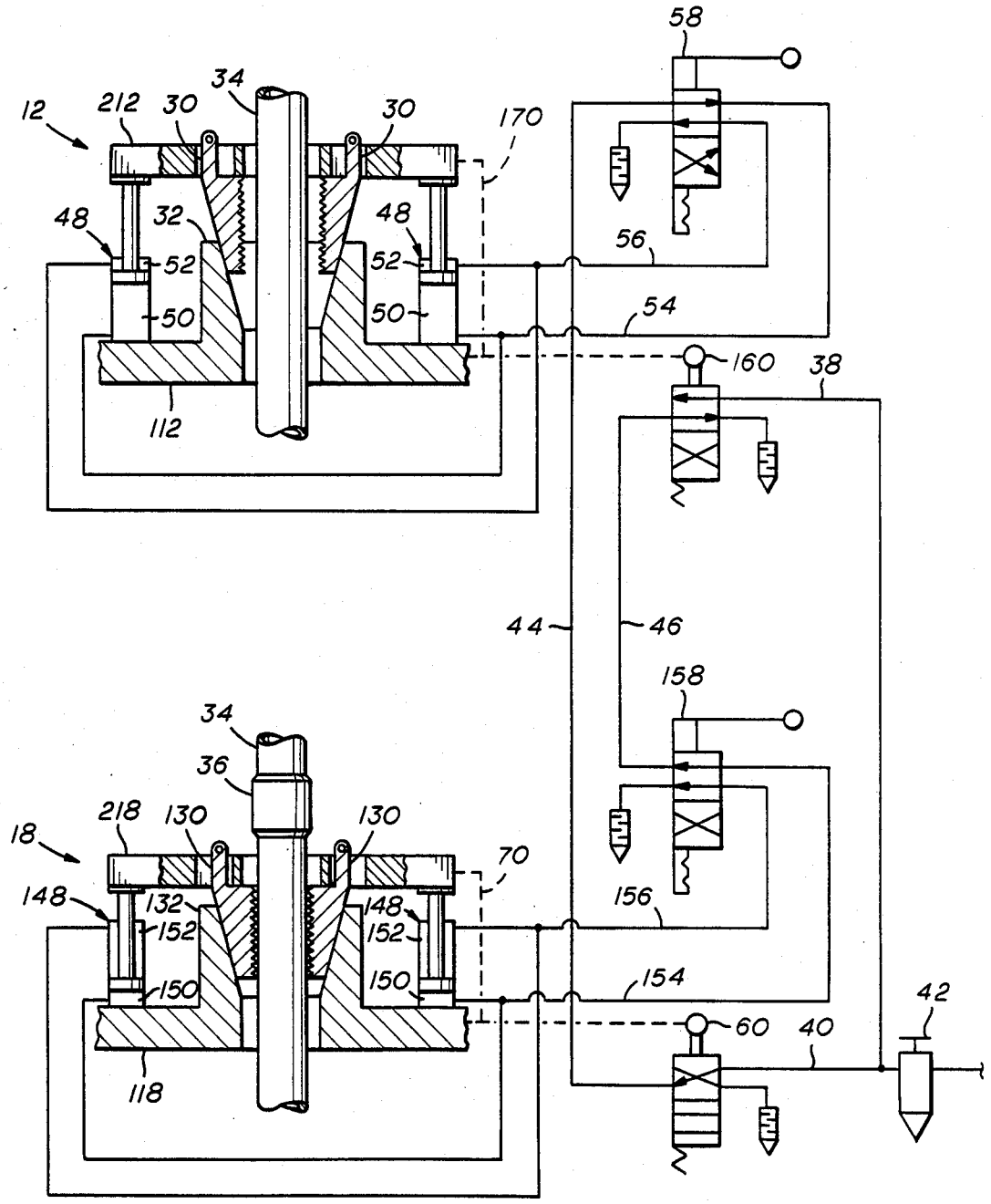
FIG. 4 is a schematic illustration of the elevator slip assembly and the spider slip assembly along with the fluid pressure connections of the operator actuated valves and the slip position actuated valves of the present invention.

The elevator slip assembly 12 and the slip spider assembly 18 are illustrated in FIG. 4 purely for functionality and do not reflect the actual internal construction of the elevator 12 and the spider 18 as appearing in FIG. 1. It will be seen that the schematic representation of elevator 12 and spider 18 is similar to corresponding assemblies as shown in U.S. Pat. No. 3,722,603. Though schematic and functional, the elevator 12 and the spider 18 as shown in FIG. 4 accurately correspond to the function of the same elements or parts thereof as shown in FIGS. 1–3.

In FIG. 4 the elevator 12 is to include a plurality of slips 30 adapted to be guided into a slip bowl 32 to be engaged and disengaged from the well casing 34. In this particular view, the slips 30 are pulled up in retracted position so as to be free and clear of the casing 34 and the casing collar 36.

The elevator 12 is equipped with two slip piston cylinder assemblies 48 which form respectively a slip release pressure chamber 50 and a slip closure pressure chamber 52. The slip release chambers 50 are connected through a conduit 54 into a manually actuated two-position slip actuator valve 58. The slip closure chambers 52 are connected through a slip closure conduit or line 56 also into the two-position valve 58. The valve 58 is adapted to admit fluid pressure into slip release chambers 50 while venting fluid pressure from the slip closure chambers 52 through the line 56 to atmosphere. When the valve 58 is shifted to its second position, fluid pressure is admitted to the slip closure chambers 52 while venting pressure from the release chambers 50 through line 54 to atmosphere.

Fluid pressure is admitted into the control valve 58 through a conduit or line 44 from a slip closure interlock valve 60. The interlock valve 60 is a two-position valve mechanically connected to the slips 130 and the bowl 132 of the spider assembly 18 as indicated by the dashed lines 70. The interlock control valve 60 is supplied with fluid pressure through a conduit or line 40 from an air supply source illustrated as a pressure regulator and filter 42.

The mechanical connection 70 is arranged to position valve 60 to pass air from line 40 through valve 60 and line 44 to the valve 58 at such time as the slips 130 are fully seated in the slip bowl 132 into firm gripping engagement with the casing 34. At such time as the slip 130 is in position other than positive engagement with the casing 34, the mechanical linkage 70 has positioned the interlock control valve 60 to block the passage of fluid pressure from the line 40 into the line 44 and thereby to the valve 58.

It is thus seen that the valve 58 has no air pressure supplied to actuate the elevator 12 in any manner excepting at such time as the slips 130 are fully seated into gripping position about the casing 34.

The elements and connections of the spider assembly 18 are the same as described for elevator 12 such that like elements and conduits or lines bear the same number with a "1" prefix. Accordingly, the spider assembly 18 has slip release chambers 150 connected through a line 154 into a two-position valve 158 and slip closure chambers 152 connected through a line 156 to the valve 158. The two-position slip actuator valve 158, the interlock position valve 160 is mechanically connected to the slips 30 and the slip bowl 32 of the elevator 12 by mechanical connection 170 indicated by dashed lines as previously described with reference to the mechanical connection 70 for the interlock position valve 60. The valve 160 is connected through a conduit or line 38 to the fluid supply 42 as previously described.

With the slips 30 in released position within the slip bowl 32 as shown for elevator 12, the mechanical linkage 170 has actuated the interlock position valve 160 to a position preventing fluid pressure from the line 38 to pass through the valve. Thus, the valve 158 is without fluid pressure and fluid pressure cannot be supplied to pressure either the chambers 150 or 152 until the linkage 170 is actuated by seating of the elevator slips 30 within the bowl 32 to firmly grip casing 34 by the elevator assembly 32. When the elevator 12 has firmly gripped the casing 34, then the linkage 170 will actuate the position valve 160 to pass fluid pressure from the fluid pressure line 38 and the fluid pressure line 46 into the valve 158 and thus "arm" valve 158 to admit fluid pressure into the release chambers 150 and thereby release the slips 130 from the casing 34.

OPERATION OF THE PREFERRED EMBODIMENT

Now referring to FIG. 4 in view of FIGS. 1 and 2, the spider 18 is set on the rig floor and the elevator 12 is suspended from the traveling block 26 and bales 28 as shown. In operation, the casing string 34 is suspended into the hole from elevator 12 and lowered by the traveling block 26. During this time the slips in the spider 18 are opened and the pipe 34 travels freely through it. The slips of the elevator are closed and firmly grip casing 34.

When the casing string 34 is lowered to where there is no gap between the elevator 12 and the spider 18, the slips on the spider 18 are closed, thus allowing the casing 34 to be suspended from the spider. The slips 30 in the elevator 12 are opened. The traveling block 26 is lifted with the attached elevator 12. Another single joint of casing 34 is screwed into the top of the casing string 34.

Once the casing joint is screwed into place, the elevator 12 is lowered over the casing to a point below the collar at the top of that last joint. The elevator slips 30 are then closed and the elevator is used to lift the entire string of casing 34 a very short distance. This short lift is to enable the slips 130 and the spider 18 to be opened. Now the entire casing string 34 is again suspended from the elevator 12, thus allowing the whole string to be lowered to start the sequence again for another single joint of casing.

The grip assurance interlock system shown in FIG. 4 assures that, at all times, one set of the slips 30 or 130 are closed into firm gripping contact with the body of the casing 34. If one set is not closed then the other set will not be able to be energized to be released.

It is to be noted that positioning of the interlock valves 60 and 160 by their respective linkages 70 and 170 is critical such that the respective actuating valves 58 and 158 may be actuated only when the other of the respective slips 30 and 130 are closed into firm gripping engagement with the pipe body. Closing either set of slips on a larger diameter such as a collar 36 would not permit the respective position valve 60 or 160 to actuate as described. The system therefore assures that at least one of elevator 12 or spider 18 will be firmly gripping the casing 34 at all times.

The system described above is one that utilized compressed air to open and close the slips as well as a way of transmitting signals from one tool to the other. It is readily seen that the same interlock system herein described could be used in a hydraulic circuit equally well, providing that various components are designed for hydraulic operation. It is also readily apparent that the system as herein described could be an electropnumatic system or an electrohydraulic system with the valves disclosed actuated by electrical solenoids connected through appropriate limits switches.

It will be apparent to those skilled in the art that the embodiment herein described may be modified and/or changed with such modifications or changes remaining within the spirit of the invention and the purview and scope of the appended claims.

What is claimed is:

1. In apparatus for assuring that at least one of the elevator or the spider of well casing installation apparatus is fully closed in gripping connection about a well casing before the other of said elevator or said spider may be released from fully closed gripping connection about said well casing, the continuation comprising:

(a) two-position elevator valve means connected to admit fluid pressure into said elevator and to optionally direct said fluid pressure to open and to close said elevator;

(b) two-position spider valve means connected to admit fluid pressure into said spider and to optionally direct said fluid pressure to open and to close said spider;

(c) two-position spider position valve means connected to said elevator valve means, said spider position valve means being mechanically connected to said spider for passing said fluid pressure to said elevator valve means only when said spider is fully closed into gripping position; and (d) two-position elevator position valve means connected to said spider valve means, said elevator position valve means being mechanically connected to said elevator for passing fluid pressure to said spider valve means only when said elevator is fully closed into gripping position.

2. The combination of claim 1 wherein said fluid pressure is air pressure.

3. The combination of claim 1 wherein said fluid pressure is hydraulic pressure.

4. The combination of claim 1 wherein all said valve means are electrically actuated by electrical solenoids with said position valve means being mechanically connected with electrical limit switch means.

5. In apparatus for installing casing in a well bore including a drilling rig having a traveling block and a supportive rig floor, a casing gripping fluid actuated casing elevator assembly carried by the traveling block and a casing gripping fluid actuated casing spider assembly mounted on the rig floor, the elevator assembly and the spider assembly each having a piston in a pressurable closing chamber to actuate slips into gripping engagement with casing when the closing chamber is pressurized, and a pressurable opening chamber also containing a piston to move the slips into release from the casing when the opening chamber is pressurized, the improvement of casing grip control apparatus for assuring correct and appropriate gripping of the elevator assembly and the spider assembly onto well casing comprising:

(a) a first two-position control valve respectively connected into the closing chamber and the opening chamber of said elevator assembly;

(b) a second two-position control valve respectively connected into the closing chamber and the opening chamber of said spider assembly;

(c) each said first and said second control valves being optionally actuated to admit fluid pressure alternately into a closing chamber and an opening chamber while venting the other chamber to atmosphere;

(d) a third two-position control valve connected to be in a first open position when said spider is in fully closed gripping position and in a second closed position when said spider is other than fully closed;

(e) a forth two-position control valve means connected to be in a first open position when said elevator is in fully closed gripping position and a second closed position when said elevator is other than fully closed;

(f) said third control valve being connected to pass fluid pressure from a pressure source to said first control valve only when said third control valve is in first open position; and (g) said fourth control valve connected to pass fluid pressure from a pressure source to said second control valve only when said fourth control valve is in first open position.

6. The combination of claim 5 wherein said fluid pressure is air pressure.

7. The combination of claim 6 wherein all said valve means are electrically actuated by electrical solenoids with said position valve means being mechanically connected with electrical limit switch means.

8. The combination of claim 5 wherein said fluid pressure is hydraulic pressure.

9. The combination of claim 8 wherein all said valve means are electrically actuated by electrical solenoids with said position valve means being mechanically connected with electrical limit switch means.

10. In a method of assuring at least one of the elevator or the spider of well casing installation apparatus is fully closed in gripping connection about a well casing before the other of said elevator or said spider may be released from said fully closed gripping connection about said well casing, the steps comprising:

(a) supplying fluid pressure to a two-position elevator valve connected to admit fluid pressure into said elevator and optionally directing said fluid pressure to open and to close said elevator;

(b) supplying fluid pressure to a two-position spider valve connected to admit fluid pressure into said spider and to optionally direct said fluid pressure to open and to close said spider;

(c) passing fluid pressure from a two-position spider position valve to said elevator valve, said spider position valve being mechanically connected to said spider for passing said fluid pressure to said elevator valve only when said spider is fully closed into gripping position; and (d) passing fluid pressure from a two-position elevator position valve to said spider valve, said elevator position valve being mechanically connected to said elevator for passing fluid pressure to said spider valve only when said elevator valve is fully closed into gripping position.

11. The method of claim 10 wherein said fluid pressure is air pressure.

12. The method of claim 10 wherein said fluid pressure is hydraulic pressure.

* * * * *